US005206784A

United States Patent [19]

Kimiwada et al.

[11] Patent Number: 5,206,784

[45] Date of Patent: Apr. 27, 1993

[54] CHARGER FOR ELECTROPHOTOGRAPHY HAVING A GRID ASSEMBLY

[75] Inventors: Yasushi Kimiwada; Akira Terakado; Minoru Seino; Yasushi Hashimoto; Koji Kato; Isamu Komatsu, all of Ibaraki, Japan

[73] Assignee: Hitachi Koki Co., Ltd., Tokyo, Japan

[21] Appl. No.: 483,552

[22] Filed: Feb. 22, 1990

[30] Foreign Application Priority Data

Apr. 14, 1989 [JP] Japan ..... 1-95806

[51] Int. Cl.[5] ..... G03G 15/02

[52] U.S. Cl. ..... 361/229; 355/225

[58] Field of Search ..... 361/229, 230, 231, 233; 250/324–326; 355/213, 219, 221–226

[56] References Cited

U.S. PATENT DOCUMENTS

| | | | |
|---|---|---|---|
| 3,382,360 | 5/1968 | Young et al. | 250/326 |
| 4,074,134 | 2/1978 | Roalson | 250/324 |
| 4,141,648 | 2/1979 | Gaitten et al. | 250/325 X |
| 4,494,856 | 1/1985 | Aoki et al. | 355/225 |
| 4,558,221 | 12/1985 | Gundlach et al. | 250/325 |
| 4,652,754 | 3/1987 | Almeter et al. | 250/325 |

OTHER PUBLICATIONS

Patent Abstracts of Japan, vol. 12, No. 224, p. 721, Jun. 25, 1988, abstract of 63-17473.

*Primary Examiner*—Jeffrey A. Gaffin
*Assistant Examiner*—David Osborn
*Attorney, Agent, or Firm*—Sughrue, Mion, Zinn, Macpeak & Seas

[57] ABSTRACT

An electrophotographic charger of the type in which a plurality of corona wires extend in the axial direction adjacent to and separated from the surface of a photosensitive drum in order to charge the surface. A plate-like etching grid is interposed between the corona wires and the drum to ensure the charge is uniformly placed on the drum. The grid is divided into a number of individual removable grids so that the distance between each grid and the adjacent corona wire, and the distance between each grid and the drum surface is substantially uniform.

2 Claims, 1 Drawing Sheet

CHARGER FOR ELECTROPHOTOGRAPHY HAVING A GRID ASSEMBLY

FIELD OF THE INVENTION

The present invention relates to an improvement of a charger for electrophotography or an electrophotographic charger.

DESCRIPTION OF THE PRIOR ART

FIG. 3 is a sectional view of a conventional electrophotographic charger in which two corona wires 1 are provided parallel to each other so as to be separated from the surface of a cylindrical photosensitive drum 2 with a predetermined interval therebetween so that a current for charging the photosensitive drum 2 is caused to flow through the corona wires 1.

Further, the corona wires 1 are electromagnetically shielded by means of a shielding casing 3. An etching grid 4 made of a stainless steel flat plate is provided between the photosensitive drum 2 and the corona wires 1 so as to make uniform the charges on the surface of the photosensitive drum 2.

The number of the corona wires 1 may be two and the length of the etching grid 4 perpendicular to the axial direction of the photosensitive drum 2, that is, the width of the etching grid 2, may be relatively short in the case of a relatively low printing speed. However in many cases three or more corona wires 1 are used for high printing speed devices and the grid width is accordingly relatively wide.

FIG. 4 is a sectional view of another conventional electrophotographic charger, in which three corona wires 1 are covered with one plate-like etching grid 4. Accordingly, a wide etching grid 4 is required.

In an electrophotographic charger, the etching grid serves to suppress unevenness in charges on the photosensitive drum, and as shown in FIG. 4, a interval d is maintained between the photosensitive drum surface and the etching grid at their closest approach.

In the case where printing speed is relatively low and the width of the etching grid is small, the difference between the interval d at the control portion and the interval d' at each of the opposite end portions is so small that the difference can be substantially neglected.

In the case where the printing speed is relatively high, however, the width of the etching grid becomes large as the number of the corona wires increases, so that the difference between the interval d' at each of the opposite end portions and the interval d at the central portion becomes large. Since the distance between the corona wires and the drum surface is uniform, the end portions of the etching grid approach the corona wires and the charging effect is deteriorated.

As a countermeasure to the above problem, the etching grid can be provided with a curvature which matches that of the outer circumferential surface of the photosensitive drum. It is however very difficult to give a curvature to the etching grid and to fix the etching grid while maintaining the curvature because the etching grid is made of a stainless steel plate having a thickness of about 0.1–0.3

SUMMARY OF THE INVENTION

It is an object of the present invention to provide an electrophotographic charger in which the charging effect at opposite end portions of an etching grid for suppressing unevenness in charges on a photosensitive drum can be prevented from deteriorating so that the performance of the charger can be improved even in the case of high printing speed.

According to the present invention, the plate-like etching grid is divided into divisional etching grids along the axial direction of a photosensitive drum in a manner so that the intervals between the respective divisional etching grids and the surface of the photosensitive drum are made equal to each other over all of the whole region where the divisional etching grids and the outer circumferential surface of the photosensitive drum are opposite to each other.

According to the present invention, the plate-like etching grid is divided so that the intervals between the photosensitive drum surface and the divisional etching grids are made equal to each other. Thus it is possible to prevent the opposite end portions of the etching grid from too closely approaching to the corona wires to lower the charging effect even in the case of a relatively high printing speed.

DETAILED DESCRIPTION OF PREFERRED EMBODIMENT

Figure 1:
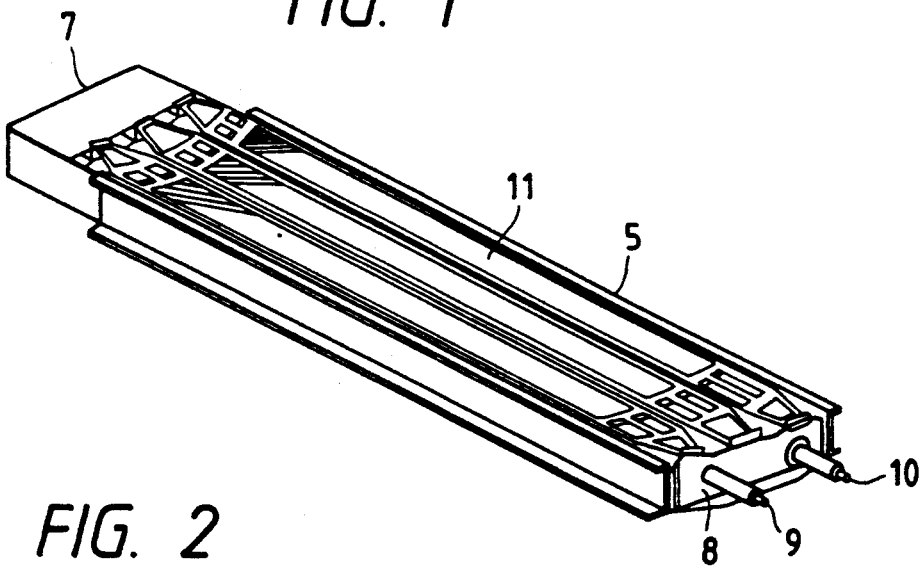
FIG. 1 is a perspective view of an embodiment of the electrophotographic charger according to the present invention.

Referring to the drawings an embodiment of the electrophotographic charger according to the present invention will be described hereunder.

Figure 2:
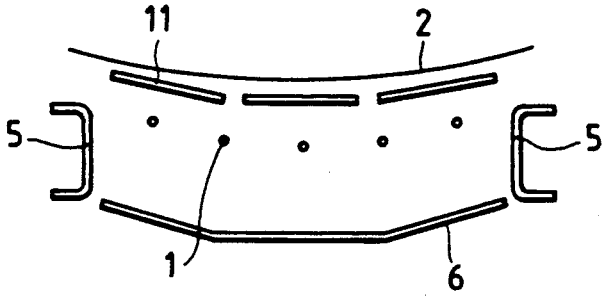
FIG. 2 is a sectional view of FIG. 1.
Figure 3:
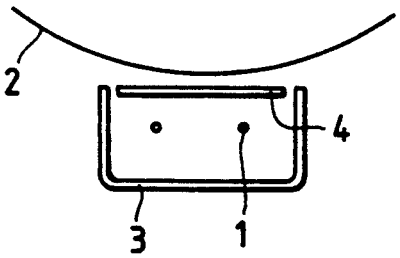
PRIOR ART FIG. 3
FIG. 3 is a sectional view of a conventional electrophotographic charger.
Figure 4:
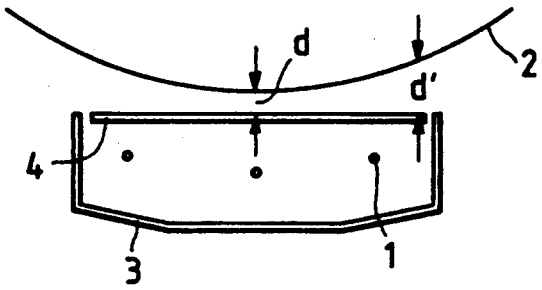
PRIOR ART FIG. 4
FIG. 4 is a sectional view of another conventional electrophotographic charger.

FIG. 1 is a perspective view of an embodiment of the electrophotographic charger according to the present invention, and FIG. 2 is a sectional view of FIG. 1.

In FIGS. 1 and 2, a plurality of corona wires 1 are provided so as to be parallel to each other in the axial direction of a photosensitive drum 2 and so as to be separated from the surface of the photosensitive drum 2 with a predetermined distance between the corona wires 1 and the photosensitive drum 2. The corona wires 1 are electromagnetically shielded by a housing constituting side-surface shielding plates 5 and a back-surface shielding plate 6. The electrophotographic charger further includes a front block 7, a rear block 8, a grid feeding plug 9, and a corona wire feeding plug 10.

In this embodiment, the pate-like etching grid interposed between the corona wires 1 and the photosensitive drum 2 is divided into three portions each extending along the axial direction of the photosensitive drum 2, and the respective etching grids 11 are arranged so as to be separated from the surface of the photosensitive drum 2 with equal intervals or spaces therebetween.

In this embodiment of the present invention, since the etching grid is divided, it is possible to make the etching grid in effect have a "curvature", so as to accord with the curvature of the outer circumferential surface of the photosensitive drum. Accordingly, opposite end portions of the etching grid do not approach the corona wires and lower the charging effect.

Further, when the etching grid is divided into portions, handling becomes easy, manufacture is still inexpensive and cost is reduced.

Further, when the etching grid is divided into portions, only the portion or portions need be changed in the case where the etching grid is partly damaged or becomes partly dirty, so that the change can be carried out inexpensively.

Although the etching grid is divided into three portions for five corona wires in the illustrated embodiment, the division is not limited to three. For example, the etching grid may be divided into portions equal in number to the corona wires. Further, even in the case of one or two corona wires, the etching grid may be divided with relation to the curvature of the outer circumferential surface of the photosensitive drum.

According to the present invention, it is possible to obtain an electrophotographic charger in which the problems in the prior art can be solved, and in which it is possible to prevent the lowering of the charging effect from occurring at the opposite end portions of the etching grid which suppresses unevenness in charges on the photosensitive drum. Thus, performance can be improved even in the case of a relatively high printing speed.

What is claimed is:

1. An electrophotographic charger for a photosensitive drum, said charger comprising:

a plurality of corona wires spaced regularly and extending linearly in a longitudinal direction of the photosensitive drum, said corona wires being disposed equidistant, by a predetermined distance, from the surface of the drum; and a grid assembly comprising a plurality of separately attached, individually removable etching grids, said grid assembly being interposed between said corona wires and the photosensitive drum such that a charge is uniformly spread over a peripheral surface of the photosensitive drum and such that a distance between said grid assembly and said corona wires is substantially uniform over said peripheral surface.

2. An electrophotographic charger for a photosensitive drum, as recited in claim 1, further comprising a housing including two C-shaped side-surface shielding plates and a jointed, back-surface shielding plate, said corona wires and said grid assembly being disposed longitudinally within said housing, said housing further including a front block and rear block positioned, respectively, at opposite, longitudinal ends of said housing, a grid feeding plug and corona wire feeding plug each being in electrical connection, respectively, with said grid assembly and said corona wires, through said rear block.

* * * * *